US008898887B2

(12) United States Patent
Kim

(10) Patent No.: US 8,898,887 B2
(45) Date of Patent: Dec. 2, 2014

(54) METHOD FOR CONTROLLING GAP IN CIRCUIT BREAKER

(75) Inventor: Woong Jae Kim, Cheongju-Si (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 207 days.

(21) Appl. No.: 13/528,685

(22) Filed: Jun. 20, 2012

(65) Prior Publication Data

US 2012/0324715 A1 Dec. 27, 2012

(30) Foreign Application Priority Data

Jun. 24, 2011 (KR) ..... 10-2011-0061954

(51) Int. Cl.

| | |
|---|---|
| ***H01H 11/06*** | (2006.01) |
| ***H01H 69/01*** | (2006.01) |
| *H01H 9/34* | (2006.01) |
| *H01H 71/16* | (2006.01) |
| *H01H 71/52* | (2006.01) |

(52) U.S. Cl.

CPC ..... *H01H 69/01* (2013.01); *H01H 9/34* (2013.01); *H01H 71/16* (2013.01); *H01H 71/522* (2013.01)

USPC ..... 29/622; 29/593; 29/464

(58) Field of Classification Search

CPC ..... H01H 69/01

USPC ..... 29/593, 121, 622, 762, 729, 464; 377/37, 39, 59, 14

See application file for complete search history.

(56) References Cited

U.S. PATENT DOCUMENTS

| | | | | | |
|---|---|---|---|---|---|
| 3,230,607 | A | * | 1/1966 | Gelzer | 29/593 |
| 3,452,428 | A | * | 7/1969 | Salomon | 29/593 |
| 3,596,352 | A | * | 8/1971 | Isler | 29/622 |
| 4,899,119 | A | * | 2/1990 | Belbel et al. | 335/14 |
| 5,105,058 | A | * | 4/1992 | Perret | 218/65 |
| 5,136,454 | A | * | 8/1992 | Halferty et al. | 361/42 |

(Continued)

FOREIGN PATENT DOCUMENTS

| | | |
|---|---|---|
| CN | 101364508 | 2/2009 |
| DE | 8416195 | 8/1984 |

(Continued)

OTHER PUBLICATIONS

Japan Patent Office Application Serial No. 2012-140817, Office Action dated Aug. 20, 2013, 2 pages.

(Continued)

*Primary Examiner* — Peter DungBa Vo
*Assistant Examiner* — Kaying Kue
(74) *Attorney, Agent, or Firm* — Lee, Hong, Degerman, Kang & Waimey

(57) ABSTRACT

Disclosed is a method for controlling a gap in a circuit breaker, the circuit breaker configured to interrupt a circuit by separating a movable contactor from a fixed contactor as a cross bar is pressed to be rotated by a pressing member due to bending of a bimetal, the method including: a gap forming step of bending the bimetal by apply of a set current, in a state where the pressing member is coupled to a coupling hole so as to be freely-movable, the coupling hole formed at an upper part of the bimetal; and a gap fixing step of interrupting the set current when a prescribed time has lapsed, and of welding the pressing member to the bimetal.

9 Claims, 6 Drawing Sheets

(56) References Cited

U.S. PATENT DOCUMENTS

| | | | | |
|---|---|---|---|---|
| 5,317,471 | A * | 5/1994 | Izoard et al. | 361/105 |
| 5,467,523 | A * | 11/1995 | Seaman | 29/622 |
| 5,581,192 | A * | 12/1996 | Shea et al. | 324/722 |
| 6,094,126 | A * | 7/2000 | Sorenson | 337/37 |
| 6,218,917 | B1 * | 4/2001 | Criniti et al. | 335/35 |
| 6,307,460 | B1 * | 10/2001 | Yu | 337/37 |
| 7,583,175 | B2 * | 9/2009 | Yu | 337/59 |
| 7,626,482 | B2 * | 12/2009 | Huang | 337/59 |
| 7,982,577 | B2 * | 7/2011 | Yu | 337/66 |
| 2004/0114295 | A1 * | 6/2004 | Kim | 361/115 |

FOREIGN PATENT DOCUMENTS

| | | |
|---|---|---|
| JP | 01-255517 | 10/1989 |
| JP | 2-131238 | 10/1990 |
| JP | 04-158810 | 6/1992 |
| JP | 05-013995 | 1/1993 |
| JP | 05-058310 | 3/1993 |
| JP | 07-192597 | 7/1995 |
| JP | 2001-015006 | 1/2001 |
| JP | 2002-260515 | 9/2002 |
| JP | 2002-324473 | 11/2002 |
| JP | 2010-192151 | 9/2010 |

OTHER PUBLICATIONS

European Patent Office Application Serial No. 12172937.0, Search Report dated Oct. 10, 2012, 6 pages.

Japan Patent Office Application Serial No. 2012-140817, Notice of Allowance dated Jan. 14, 2014, 3 pages.

The State Intellectual Property Office of the People's Republic of China Application Serial No. 201210213917.0, Office Action dated Apr. 17, 2014, 9 pages.

* cited by examiner

METHOD FOR CONTROLLING GAP IN CIRCUIT BREAKER

CROSS-REFERENCE TO RELATED APPLICATION

Pursuant to 35 U.S.C. §119(a), this application claims the benefit of earlier filing date and right of priority to Korean Application No. 10-2011-0061954, filed on Jun. 24, 2011, the contents of which is incorporated by reference herein in its entirety.

BACKGROUND OF THE INVENTION

1. Field of the Invention

The present disclosure relates to a circuit breaker, and more particularly, to a method for controlling a gap in a circuit breaker which detects an accident current and interrupt a circuit, the method capable of automatically setting a gap between a bimetal and a cross bar with respect to a time delay operating characteristic by a detection mechanism.

2. Background of the Invention

A circuit breaker serves to open or close a load in an electric power substation or on an electrical circuit line, etc., or to interrupt a current when an accident such as a ground fault or a short-circuit current occurs. The circuit breaker converts a state of an electrical circuit into an 'OFF' or 'ON' state according to a user's manipulation. In the occurrence of an overload and a short-circuit current on the electrical circuit, the circuit breaker interrupts the circuit to protect the load and the electrical circuit.

The circuit breaker has a time-limited trip characteristic and an instantaneous trip characteristic. The time-limited trip characteristic indicates an over-current trip characteristic having an operation time inversely-proportional to an over-current value. And, the time-limited trip characteristic includes a thermal magnetic type using a thermal factor such as bi-metal, and a hydraulic magnetic type using a breaking operation of an oil dash pot (ODP).

The instantaneous trip characteristic is used to rapidly trip a circuit breaker by a large over-current such as a short-circuit current. And, the time-limited trip characteristic is used to trip a circuit breaker before the temperature of a wire reaches a dangerous state by Joule's heat, when an over-current more than a rated current flows on the wire.

Hereinafter, the time-limited trip characteristic will be explained. It is advantageous for a circuit breaker to rapidly operate in the aspect of protection. However, an over-current such as an initial driving current of a motor, as well as a normal load current, flows on an electrical circuit. Accordingly, the circuit breaker preferably operates with time delay within a range that the temperature of the electrical circuit does not exceed an allowable temperature, so that the circuit breaker can be prevented from operating by the over-current. Therefore, the time-limited trip characteristic may be also referred to as a time delay operating characteristic.

Once an over-current is applied to the circuit breaker, heat is generated from a heater. Such generated heat is conducted to a bimetal to cause the bimetal to be bent due to a thermal conduction difference between two members of the bimetal. As the bimetal is bent, a cross bar is pressed to be rotated. As a result, a switching mechanism operates to convert a state of the electrical circuit into an open state, thereby interrupting the circuit.

A factor which determines time delay in the time delay operating characteristic is a time duration from time when the bimetal starts to be bent due to an over-current, to time when the switching mechanism operates by rotation of the cross bar. Such time delay is determined based on an initial gap between a bimetal and a cross bar, a reactive bending amount from a time point when the bimetal comes in contact with the cross bar, to a time point when the cross bar rotates by a bending load of the bimetal, and a rotation distance of the cross bar until when the switching mechanism starts to operate upon rotation of the cross bar.

A rotation degree of the bimetal, i.e., a bending amount is determined based on the aforementioned factors. The reactive bending amount and the rotation distance of the cross bar are influenced by an individual characteristic of the circuit breaker. Therefore, it is difficult to minutely adjust the reactive bending amount and the rotation distance of the cross bar, unless the components are replaced. As a result, the only factor which determines time delay in the time delay operating characteristic is the gap between the bimetal and the cross bar.

If the gap between the bimetal and the cross bar is too small, a trip time of the circuit breaker is shortened. This may cause the circuit to be interrupted even in a state of an over-current such as an initial driving current. On the contrary, if the gap between the bimetal and the cross bar is too large, the circuit breaker may have trip time delay, or may not be tripped. This may cause an over-current to be supplied to the circuit, resulting in damages of the circuit.

Generally, the circuit breaker has a plurality of rated currents within the same structure. Therefore, when considering the number of types of bimetals and heaters, it is impossible to implement a constant gap and to satisfy the time delay operating characteristic with respect to an over-current in a single circuit breaker.

Generally, the circuit breaker is categorized into several types based on the amount of heat generated from a heater and a bending amount of the bimetal when an over-current flows. And, the gap between the bimetal and the cross bar is adjusted when manufacturing the circuit breaker, for a precise time delay operating characteristic.

The gap control is differently performed according to each rating, and is generally performed by an operator. More specifically, a contact gap between a screw and the cross bar is formed by controlling the height of the screw coupled to an upper part of the bimetal. To this end, the operator inserts a gap gauge between the cross bar and the screw, and rotates the screw so that the screw can be adhered to the gap gauge. Then, the operator removes the gap gauge, and fixes the screw to the cross bar.

Generally, it is necessary to minutely control the gap within the range of 0.1 mm. However, since the aforementioned gap control is manually performed, an error occurs according to each operator. Furthermore, even if the same operator performs the gap control, an error may occur according to each product. The time delay operating characteristic of the circuit breaker may be influenced by such error, and thus the quality of the circuit breaker may be lowered.

Furthermore, if the process is manually performed, it takes a lot of time to perform the gap control. This may lower the productivity.

SUMMARY OF THE INVENTION

Therefore, an aspect of the detailed description is to provide a method for controlling a gap in a circuit breaker, the method capable of automatically setting a gap between a bimetal and a cross bar, the gap serving as a critical factor which determines a time delay operating characteristic of the circuit breaker.

To achieve these and other advantages and in accordance with the purpose of this specification, as embodied and broadly described herein, there is provided a method for controlling a gap in a circuit breaker, the circuit breaker configured to interrupt a circuit by separating a movable contactor from a fixed contactor as a cross bar is pressed to be rotated by a pressing member due to bending of a bimetal, the method comprising: a gap forming step of bending the bimetal by apply of a set current, in a state where the pressing member is coupled to a coupling hole so as to be freely-movable, the coupling hole formed at an upper part of the bimetal; and a gap fixing step of interrupting the set current when a prescribed time has lapsed, and of welding the pressing member to the bimetal.

The gap forming step may include an adhering step of adhering the pressing member to the cross bar in a state where the pressing member is coupled to a coupling hole so as to be freely-movable, the coupling hole formed at an upper part of the bimetal; and a current applying step of applying a set current for a set time such that the bimetal is bent and the pressing member is relatively moved toward the bimetal in a state where the pressing member is adhered to the cross bar.

The gap fixing step may include a current interrupting step of interrupting the set current when the set time has lapsed; and a welding step of coupling the pressing member to a coupling hole by welding, the coupling hole formed at an upper part of the bimetal.

In the welding step, the welding may be automatically performed by laser welding. In the welding step, a bending position of the bimetal may be checked by a reflection-type optical sensor, and laser welding may be performed.

According to one embodiment of the present invention, the method may further comprise a trip stroke measuring step of measuring a rotation displacement of the cross bar, the rotation displacement required to separate the movable contactor from the fixed contactor.

If the rotation displacement of the cross bar measured in the trip stroke measuring step exceeds a reference value, the set current may be decreased. ON the other hand, if the rotation displacement of the cross bar measured in the trip stroke measuring step is less than the reference value, the set current may be increased.

The method may further comprise a cooling step of cooling the heated bimetal and the pressing member after the gap fixing step.

The method may further comprise a riveting step of riveting the end of the pressing member so as to prevent the pressing member from being separated from the coupling hole of the bimetal.

The present invention may have the following advantages.

Firstly, since the gap between the bimetal and the cross bar is controlled to be fixed in an automatic manner, not in a manual manner, productivity can be enhanced and the cost can be saved.

Secondly, since the gap between the bimetal and the cross bar is controlled to be fixed in an automatic manner, not in a manual manner, the probability of error occurrence can be reduced, and thus the quality of the circuit breaker can be enhanced.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of the exemplary embodiments, with reference to the accompanying drawings. For the sake of brief description with reference to the drawings, the same or equivalent components will be provided with the same reference numbers, and description thereof will not be repeated.

Figure 1:
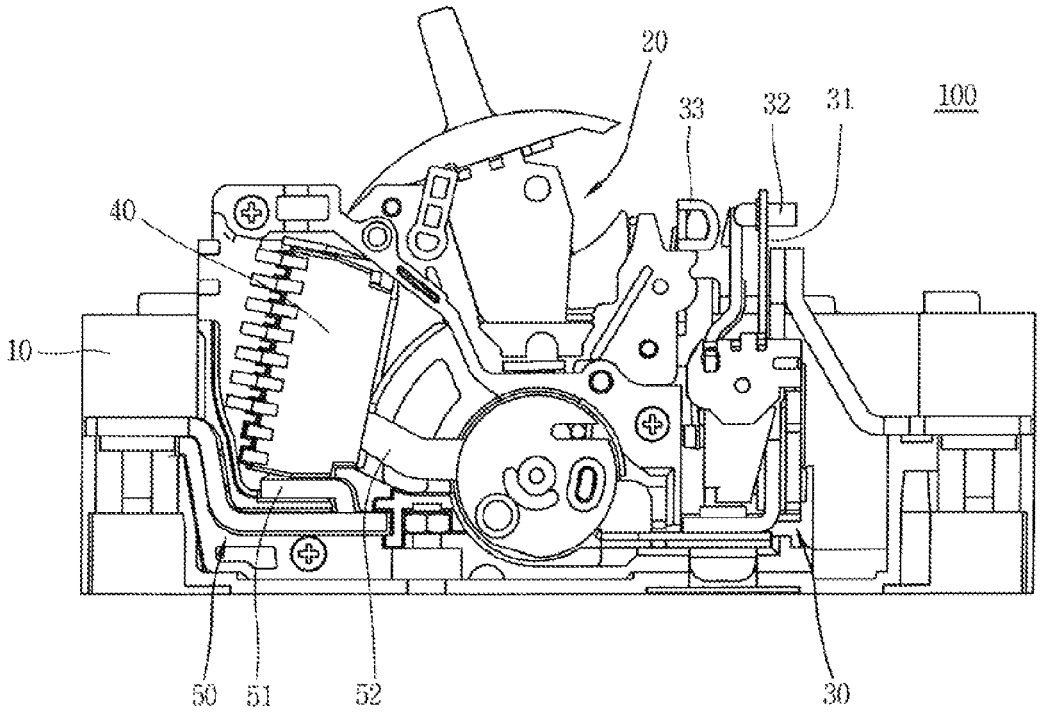
FIG. 1 is a schematic view of a circuit breaker according to the present invention.

FIG. 1 is a schematic view of a circuit breaker according to the present invention.

Referring to FIG. 1, the circuit breaker 100 includes a case 10 configured to accommodate components therein. The case 10 is molded by an insulating material, and is configured to insulate the inside from the outside. Such structure is general, and thus its detailed explanations will be omitted.

In the case 10, provided are a switching mechanism 20 configured to turn on/off an electrical circuit, a terminal part 50 including a fixed contactor 51 and a movable contactor 52 to which power and a load are connected, respectively, a detection mechanism 30 configured to detect an abnormal current and an accidental current such as an over-current, an extinguishing device 40 configured to extinguish an arc generated between contacts of the movable contactor 52 and the fixed contactor 51 when the electrical circuit was interrupted, etc.

The terminal part 50 includes a fixed contactor 51 connected to an input side power and fixed to the case 10, and a movable contactor 52 connected to a load side, and rotatably mounted at the case 10 so as to contact or be separated from the fixed contactor 51.

The movable contactor 52 is mechanically connected to the switching mechanism 20, and is manually driven by a lever.

Alternatively, the movable contactor 52 is driven by the switching mechanism 20 operated by the detection mechanism 30.

In case of protecting the circuit through a tripping operation by separating the movable contactor 52 from the fixed contactor 51 in the occurrence of an accidental current, an arc which is in a high-temperature plasma state occurs because an insulated state in the air is not implemented any longer due to a current between the contacts. Furthermore, an arc pressure may occur due to gas generated as peripheral insulating materials, etc. are melted by the arc. Such arc is divided and cooled, and such arc pressure is discharged out by the extinguishing device 40.

The detection mechanism 30 has a configuration to implement a time delay operation for interrupting a circuit when an over-current more than a rated current is detected. Such detection mechanism 30 is illustrated in FIGS. 4 and 8 in more details.

Figure 4:
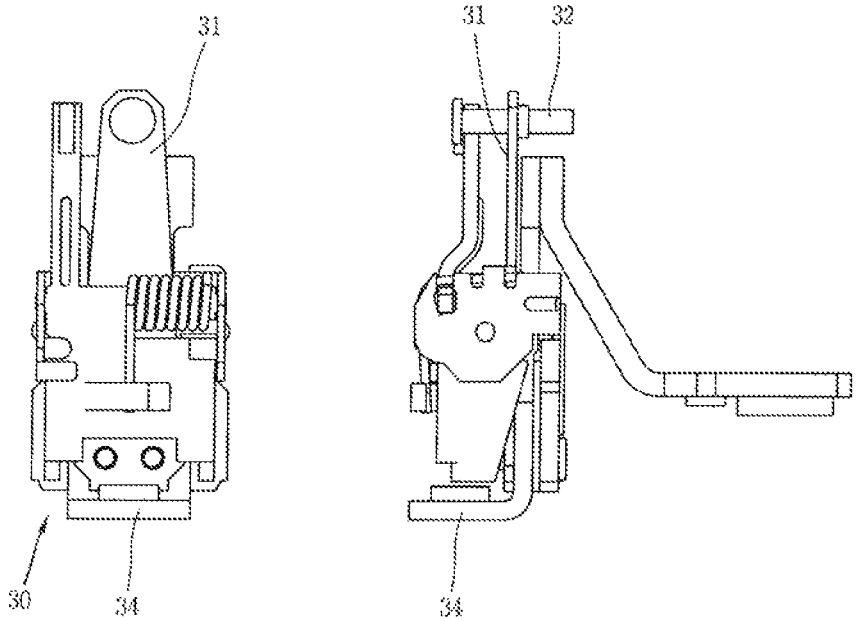
FIG. 4 shows a front view and a side view of a detection mechanism controlled by a method for controlling a gap in a circuit breaker according to the present invention.
Figure 8:
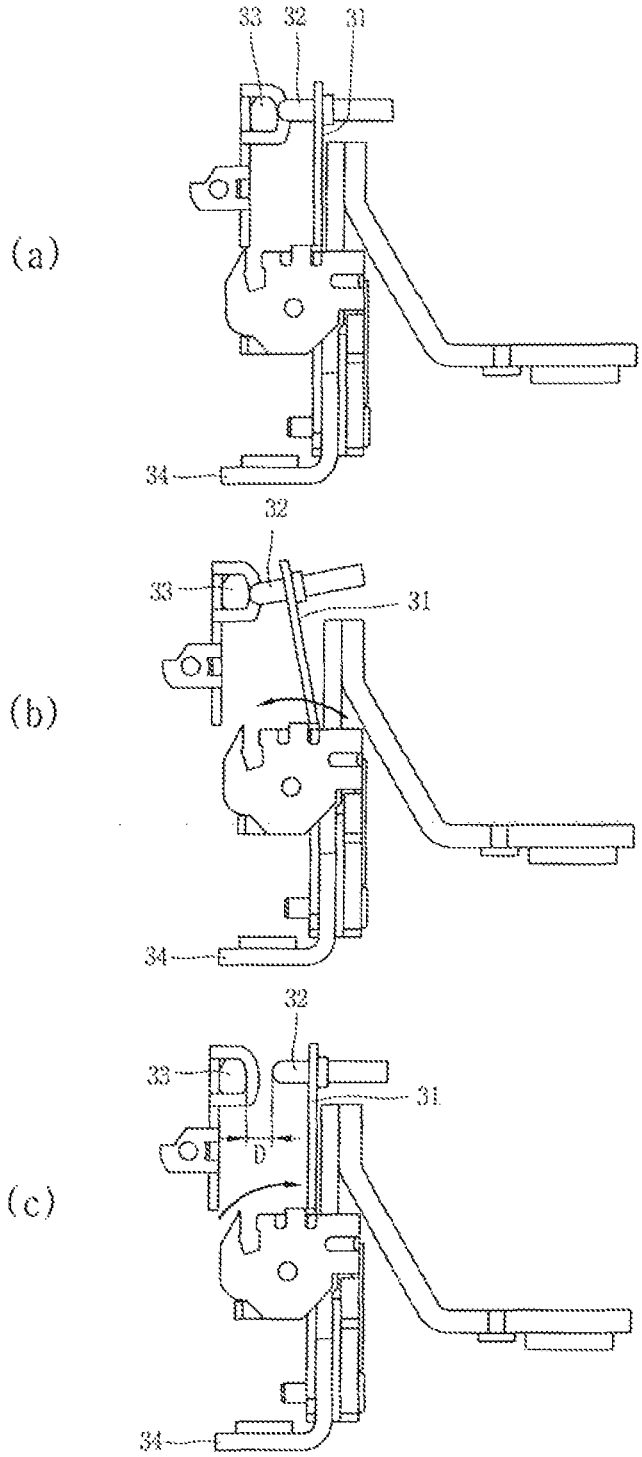
FIG. 8 is a schematic view showing a state of a detection mechanism, the state controlled by a method for controlling a gap in a circuit breaker according to an embodiment of the present invention.

Referring to FIGS. 4 and 8, the detection mechanism 30 includes a heater 34 configured to generate a proper amount of heat when an over-current occurs, a bimetal 31 connected to the heater 34 and bent to one side when receiving a proper amount of heat from the heater, a pressing member 32 protruding to be coupled to the end of the bimetal, and a cross bar 33 facing the bimetal in the protruding direction of the pressing member 32.

The bimetal 31 is formed as two metals having different thermal expansion degrees come in contact with each other, and is bent to one side when receiving heat.

Figure 5:
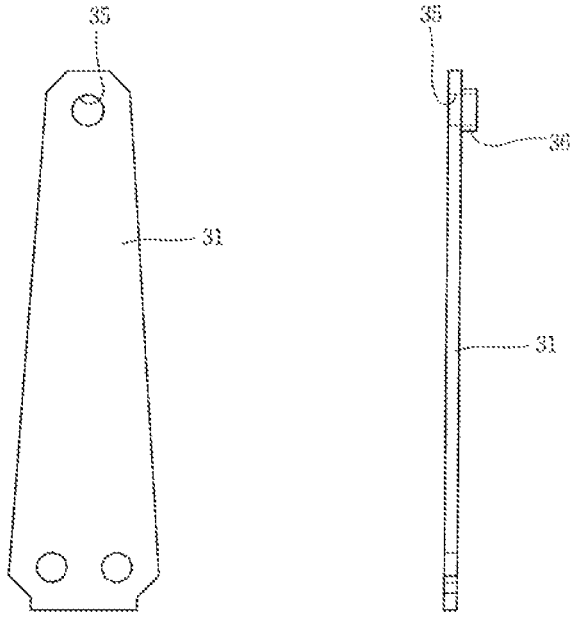
FIG. 5 shows a front view and a side view of a bimetal of the detection mechanism of FIG. 4.

FIG. 5 shows the bimetal 31 in more details, and FIG. 8 shows the bimetal 31 which is in a bent state.

Referring to FIG. 5, the bimetal 31 has a long rectangular plate shape. A coupling hole 35 for coupling a pressing member 32 to be later explained is provided at an upper part of the bimetal 31. A tap 36 for coupling the pressing member 32 to be later explained may be provided near the coupling hole 35.

The bimetal 31 is formed to be symmetrical with each other right and left based on the coupling hole 35. An identification means may be applied onto an upper part of the bimetal 31. For instance, white paint may be applied to the upper part of the bimetal for facilitation of identification. However, the present invention is not limited to this. An identification function may be implemented by an optical sensor so that the position of the bimetal can be easily checked.

The bimetal may have a shaving-processed upper part. The shape and the processing of the bimetal 31 are implemented so as to precisely and automatically check the position of the bimetal using an optical sensor, for laser welding at the time of automatically adjusting a gap between the bimetal and a cross bar to be later explained.

Figure 6:
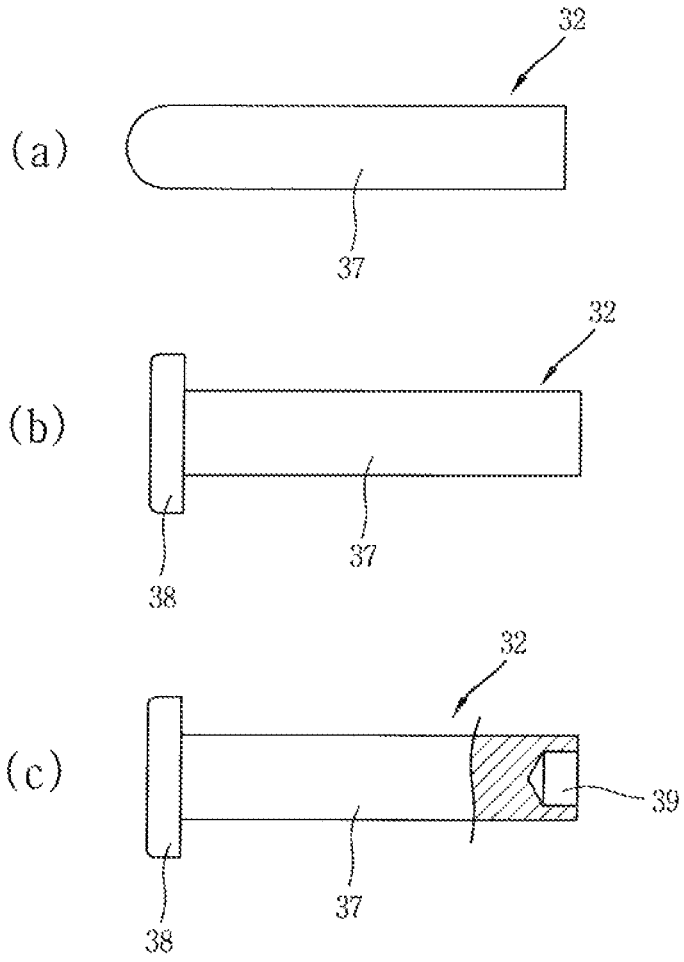
FIG. 6 is a schematic view showing various embodiments of a pressing member of the detection mechanism of FIG. 4.
Figure 7:
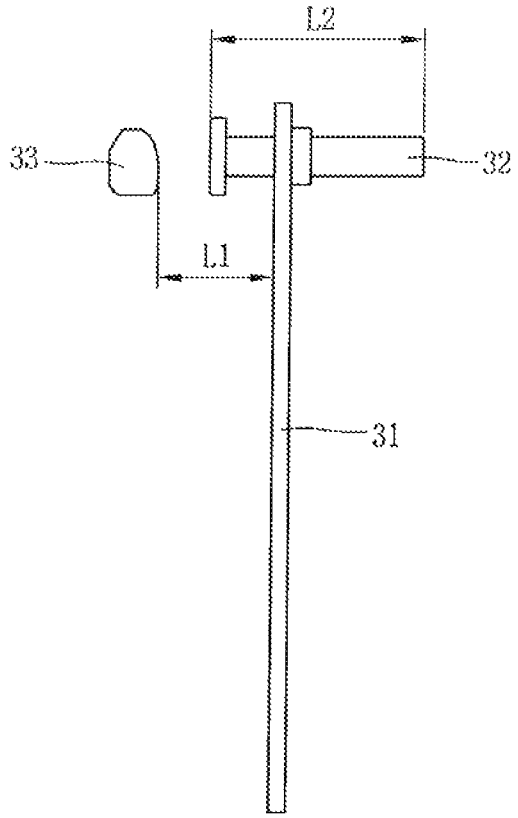
FIG. 7 is a schematic view showing positions of a pressing member and a cross bar, and a gap therebetween.

FIGS. 6 and 7 show the pressing member 32 in more details, and FIG. 8 shows a process for coupling the pressing member 32 to the bimetal 31. Especially, FIG. 6 shows various embodiments of the pressing member 32.

The pressing member 32 coupled to the coupling hole 35 formed at the upper part of the bimetal 31 has various embodiments as shown in FIG. 6. FIG. 6A shows a pressing member of a simple pillar shape. In this case, the pressing member 32 is provided with a pillar-shaped body portion 37 which penetrates through the coupling hole 35. One end of the pressing member 32 may undergo curved-surface processing for contact with a cross bar 33 to be later explained.

Referring to FIG. 6B, the pressing member has a rivet shape. Such pressing member 32 includes a body portion 37 which penetrates through the coupling hole 35, and a separation preventing portion 38 formed at one end of the body portion, and having an inner diameter larger than that of the coupling hole 35. Here, the separation preventing portion 38 is formed at one end of the body portion 37, a side of the cross bar 33.

Referring to FIGS. 6A and 6B, an outer diameter of the body portion 37 of the pressing member is smaller than the inner diameter of the coupling hole 35. The reason is because the pressing member 32 should be initially coupled to the coupling hole 35 in a freely-movable state when automatically adjusting a gap between the bimetal and the cross bar. However, this is merely exemplary. After a gap (D) between the pressing member 32 and the cross bar 33 has been determined by apply of a prescribed current, the pressing member 32 is bonded to the coupling hole 35.

As shown in FIG. 7, a length (L2) of the body portion 37 is greater than an initial gap (L1) between the cross bar 33 and the bimetal 31. The reason is in order to prevent the pressing member from being separated from the coupling hole and the bimetal, sequentially, in an initial state where the pressing member has been coupled to the coupling hole of the bimetal so as to be freely-movable.

Referring to FIG. 6C, a riveting recess 39 for riveting the pressing member may be formed at another end of the body portion 37. Said another end indicates the end of the body portion opposite to the one cross bar-side end of the body portion. Under this structure, the pressing member is coupled to the coupling hole, and then is riveted at the riveting recess. This can prevent the pressing member from being separated from the coupling hole and the bimetal, sequentially.

The cross bar 33 mounted to the case 10 so as to face the bimetal 31 is spaced from the pressing member 32 by a prescribed gap (D), the pressing member 32 coupled to an upper part of the bimetal 31. Such state indicates a state after the pressing member has been welded to the bimetal for prevention of free moving.

The cross bar 33 is interworked with the aforementioned switching mechanism 20. That is, as the switching mechanism 20 operates by rotation of the cross bar 33, the movable contactor 52 is separated from the fixed contactor 51.

After the cross bar 33 has come in contact with the pressing member 32, the cross bar 33 is pressed by bending of the bimetal 31. As a result, the cross bar has a rotational force to operate the switching mechanism.

Figure 2:
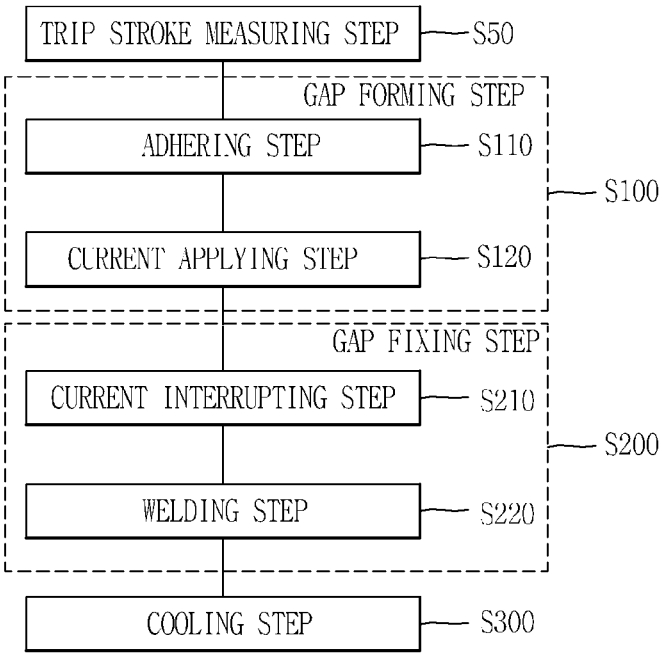
FIG. 2 is a flowchart showing a method for controlling a gap in a circuit breaker according to one embodiment of the present invention.

A method for controlling a gap in a circuit breaker according to an embodiment of the present invention is illustrated in FIG. 2. Referring to FIG. 2, the method includes a trip stroke measuring step (S50), a gap forming step (S100), a gap fixing step (S200), and a cooling step (S300).

The trip stroke measuring step (S50) indicates a pre-step of forming a gap (D) between the pressing member coupled to the upper part of the bimetal and the cross bar. In S50, the degree of a rotation displacement required to separate the movable contactor 52 from the fixed contactor 51 is measured.

The rotation displacement of the cross bar has a reference value. Such reference value is required for automation in the process of production, which is predetermined according to each rating applied to the circuit breaker.

If the rotation displacement of the cross bar measured in S50 exceeds the reference value, a set current applied to form the gap (D) between the bimetal and the cross bar is decreased. On the other hand, if the rotation displacement of the cross bar measured in S50 is less than the reference value, the set current is increased.

The gap forming step (S100) indicates a step of bending the bimetal 31 by apply of a set current, in a state where the pressing member 32 has been coupled to the coupling hole 35 so as to be freely-movable, the coupling hole 35 formed at the upper part of the bimetal. FIG. 8 illustrates applications of the gap forming step (S100).

Referring to FIGS. 2 and 8, the gap forming step (S100) includes an adhering step (S110) and a current applying step (S120). The adhering step (S110) indicates a step of adhering (closely attaching) the pressing member to the cross bar in a state where the pressing member 32 has been coupled to the coupling hole 35 so as to be freely-movable, the coupling hole 35 formed at the upper part of the bimetal. And, the current applying step (S120) indicates a step of bending the bimetal by apply of a set current for a prescribed time, and thus relatively moving the pressing member to the bimetal in a state where the pressing member has been adhered to the cross bar.

As shown in FIG. 8A, in S110, the pressing member 32 is adhered to the cross bar in a state where the pressing member 32 has been coupled to the coupling hole 35 so as to be freely-movable, the coupling hole 35 formed at the upper part of the bimetal. That is, the pressing member 32 is not fixedly-coupled to the bimetal 31.

As shown in FIG. 8B, in S120, the bimetal is bent by apply of a set current for a prescribed time. As a result, the pressing member is relatively moved toward the bimetal in a state of being adhered to the cross bar. Here, the prescribed time is required for automation in the process of production, which is predetermined according to each rating applied to the circuit breaker.

As aforementioned, the set current indicates a current determined with consideration of a rotation displacement of the cross bar measured in S50. Since the set current is an over-current, it has a numeric value where a time delay operating characteristic can be exhibited. If the rotation displacement of the cross bar exceeds a reference value, a set current applied to form the gap (D) between the pressing member coupled to the upper part of the bimetal and the cross bar is decreased. On the other hand, if the rotation displacement of the cross bar is less than the reference value, the set current is increased.

The gap (D) is formed by relatively moving the pressing member 32 toward the bimetal 31 in a state where the pressing member 32 has been adhered to the cross bar.

FIG. 8C illustrates a state after the pressing member has been fixed to the bimetal, which shows the gap (D) between the end of the pressing member 32 and the cross bar 33.

The gap fixing step (S200) indicates a step of interrupting the set current, and of welding the pressing member 32 to the bimetal 31 when a prescribed time has lapsed.

Referring to FIG. 2, the gap fixing step (S200) includes a current interrupting step (S210) and a welding step (S220). S210 is a step of interrupting the set current when a prescribed time has lapsed. And, S220 is a step of coupling the pressing member, by welding, to the coupling hole formed at the upper part of the bimetal.

The current interrupting step S210 indicates a step of making the gap (D) have no change, by interrupting the set current when a prescribed time has lapsed, and by stopping a relative movement of the pressing member 32 toward the bimetal 31 in the state of FIG. 8B.

The welding step S220 indicates a step of coupling the pressing member 32, by welding, to the coupling hole 35 formed at the upper part of the bimetal. That is, S220 indicates a step of fixing the gap (D) in the state of FIG. 8B.

In S220, laser welding is automatically performed. In S220, a bending position of the bimetal is checked by a reflection-type optical sensor, and laser welding is performed.

More specifically, the bimetal 31 is formed to be symmetrical with each other right and left based on the coupling hole 35. An identification means is applied onto an upper part of the bimetal 31, and the bimetal 31 has a shaving-processed upper part. For instance, white paint may be applied on the upper part of the bimetal for facilitation of identification. Such configurations are implemented in order to precisely and automatically check the position of the bimetal using an optical sensor.

FIG. 8C illustrates a detection mechanism cooled in the cooling step (S300). The cooling step (S300) indicates a step of cooling the heated bimetal 31 and the pressing member 32 after the gap fixing step. In S300, a natural cooling method or other cooling methods may be used.

Figure 3:
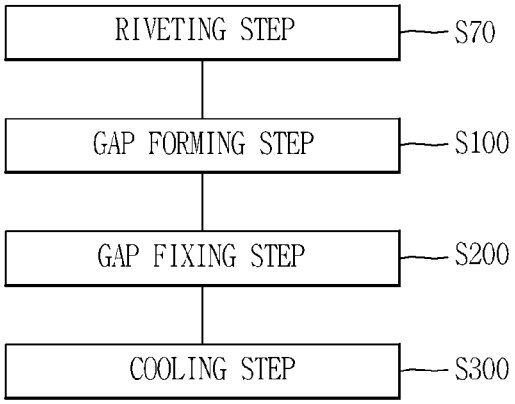
FIG. 3 is a flowchart showing a method for controlling a gap in a circuit breaker according to another embodiment of the present invention.

FIG. 3 is a flowchart showing a method for controlling a gap in a circuit breaker according to another embodiment of the present invention.

The method may further include a riveting step (S70) of riveting the end of the pressing member so that the pressing member 32 can be prevented from being separated from the coupling hole 35 of the bimetal.

Referring to FIG. 3, S70 may be performed before S100. Before S100, the pressing member may be separated from the coupling hole 35 of the bimetal since it is in a state of being freely-movable in the coupling hole 35. To prevent this, riveting is performed at the riveting recess 39 formed at another end of the body portion 37 of the pressing member 32. S70 may be performed after the gap (D) has been fixed in the gap fixing step (S200).

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A method for controlling a gap in a circuit breaker, the circuit breaker configured to interrupt a circuit by separating a movable contactor from a fixed contactor as a cross bar is pressed to be rotated by a pressing member due to bending of a bimetal, the method comprising:

a gap forming step of bending the bimetal by apply of a set current, in a state where the pressing member is coupled to a coupling hole so as to be freely-movable, the coupling hole formed at an upper part of the bimetal; and a gap fixing step of interrupting the set current when a prescribed time has lapsed, and of welding the pressing member to the bimetal.

2. The method of claim 1, wherein the gap forming step includes:

an adhering step of adhering the pressing member to the cross bar in the state where the pressing member is coupled to the coupling hole so as to be freely-movable, the coupling hole formed at the upper part of the bimetal; and a current applying step of applying the set current for the set time such that the bimetal is bent and the pressing member is relatively moved toward the bimetal in a state where the pressing member is adhered to the cross bar.

3. The method of claim 1, wherein the gap fixing step includes:

a current interrupting step of interrupting the set current when the set time has lapsed; and a welding step of coupling the pressing member to the coupling hole by welding, the coupling hole formed at the upper part of the bimetal.

4. The method of claim 3, wherein in the welding step, the welding is automatically performed by laser welding.

5. The method of claim 4, wherein in the welding step, a bending position of the bimetal is checked by a reflection-type optical sensor, and laser welding is performed.

6. The method of claim 1, further comprising a trip stroke measuring step of measuring a rotation displacement of the cross bar, the rotation displacement required to separate the movable contactor from the fixed contactor.

7. The method of claim 6, wherein if the rotation displacement of the cross bar measured in the trip stroke measuring step exceeds a reference value, the set current is decreased, and wherein if the rotation displacement of the cross bar measured in the trip stroke measuring step is less than the reference value, the set current is increased.

8. The method of claim 1, further comprising a cooling step of cooling the heated bimetal and the pressing member after the gap fixing step.

9. The method of claim 1, further comprising a riveting step of riveting the end of the pressing member so as to prevent the pressing member from being separated from the coupling hole of the bimetal.

* * * * *